US009460658B2

(12) United States Patent
Kim et al.

(10) Patent No.: US 9,460,658 B2
(45) Date of Patent: Oct. 4, 2016

(54) PIXEL AND ORGANIC LIGHT EMITTING DISPLAY DEVICE USING THE SAME

(71) Applicant: Samsung Display Co., Ltd., Gyeonggi-do (KR)

(72) Inventors: Jong-Soo Kim, Yongin (KR); Kyoung-Soo Lee, Yongin (KR); Myung-Ho Lee, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 124 days.

(21) Appl. No.: 14/269,732

(22) Filed: May 5, 2014

(65) Prior Publication Data

US 2014/0333686 A1 Nov. 13, 2014

(30) Foreign Application Priority Data

May 13, 2013 (KR) ..... 10-2013-0053667

(51) Int. Cl.

| | |
|---|---|
| ***G09G 5/02*** | (2006.01) |
| ***G09G 3/32*** | (2016.01) |
| *G09G 3/20* | (2006.01) |

(52) U.S. Cl.

CPC ..... *G09G 3/3233* (2013.01); *G09G 3/2022* (2013.01); *G09G 2300/043* (2013.01); *G09G 2300/0819* (2013.01); *G09G 2300/0852* (2013.01); *G09G 2310/061* (2013.01); *G09G 2320/0233* (2013.01); *G09G 2320/043* (2013.01)

(58) Field of Classification Search

CPC ..... G09G 3/3233; G09G 2300/0819; G09G 2320/043; G09G 2320/045

USPC ..... 345/694

See application file for complete search history.

(56) References Cited

U.S. PATENT DOCUMENTS

| | | | | |
|---|---|---|---|---|
| 2009/0051628 | A1* | 2/2009 | Kwon | 345/77 |
| 2009/0309868 | A1 | 12/2009 | Jung et al. | |
| 2014/0118322 | A1 | 5/2014 | Kim et al. | |

FOREIGN PATENT DOCUMENTS

| | | | |
|---|---|---|---|
| KR | 10-2003-0044566 | A | 6/2003 |
| KR | 10-2009-0128888 | A | 12/2009 |
| KR | 10-2014-0054758 | | 5/2014 |

* cited by examiner

*Primary Examiner* — Gustavo Polo
(74) *Attorney, Agent, or Firm* — Lee & Morse P.C.

(57) ABSTRACT

A pixel for a display panel includes an organic light emitting diode and two driving transistors. The first driving transistor supplies current from a first power source to the organic light emitting diode based on a voltage applied to a first node. The second driving transistor coupled between an electrode of the first driving transistor and the organic light emitting diode. The second driving transistor is turned on or turned off corresponding to a data signal supplied from a data line. A third transistor, coupled between a gate electrode of the second driving transistor and the data line, is turned on when a scan signal is supplied to a scan line. A compensation circuit is coupled to the first node to compensate for a voltage corresponding to a threshold voltage of the first driving transistor.

35 Claims, 12 Drawing Sheets

PIXEL AND ORGANIC LIGHT EMITTING DISPLAY DEVICE USING THE SAME

CROSS-REFERENCE TO RELATED APPLICATION

Korean Patent Application No. 10-2013-0053667, filed on May 13, 2013, and entitled: "PIXEL AND ORGANIC LIGHT EMITTING DISPLAY DEVICE USING THE SAME," is incorporated by reference herein in its entirety.

BACKGROUND

1. Field

One or more embodiments described herein relate to a pixel of a display device.

2. Description of the Related Art

A variety of flat panel displays (FPDs) have been developed in recent years.

Examples include a liquid crystal display (LCD), an organic light emitting display (OLED), and a plasma display panel (PDP). Among these FPDs, the OLED displays images using organic light emitting diodes that emit light based on recombination of electrons and holes in an active layer. The organic light emitting display has a fast response speed and is driven with low power consumption.

SUMMARY

In accordance with one embodiment, a pixel includes an organic light emitting diode; a first driving transistor configured to supply current from a first power source to the organic light emitting diode, the first driving transistor to supply the current based on a voltage applied to a first node; a second driving transistor coupled between a second electrode of the first driving transistor and the organic light emitting diode, the second driving transistor being turned on or turned off corresponding to a data signal supplied from a data line; a third transistor coupled between a gate electrode of the second driving transistor and the data line, the third transistor being turned on when a scan signal is supplied to a scan line; and a compensation circuit coupled to the first node, the compensation circuit compensating for a voltage corresponding to a threshold voltage of the first driving transistor.

The pixel may include a first capacitor coupled between the gate electrode of the second driving transistor and the first power source; and a fourth transistor coupled between a second node of the compensation unit and a bias power source, the fourth transistor being turned on when a third control signal is supplied to a third control line.

The compensation circuit may include a fifth transistor coupled between the first node and the second electrode of the first driving transistor, the fifth transistor being turned on when a second control signal is supplied to a second control line; a sixth transistor coupled between the second node and an initialization power source, the sixth transistor being turned on when a first control signal is supplied to a first control line; a seventh transistor coupled between the second node and a reference power source, the seventh transistor being turned on when the second control signal is supplied to the second control line; and a second capacitor coupled between the first and second nodes. The compensation circuit may further include a third capacitor coupled between the second node and the first power source.

The reference power source may be set to a voltage higher than a voltage of the bias power source. The reference power source may be the first power source. The initialization power source may be set to a voltage lower than a voltage of the first power source. The sixth and seventh transistors may progressively be turned on during a compensation period between frames, and the fourth transistor is set in a turn-on state during the frame.

The pixel may include a first capacitor coupled between the gate electrode of the second driving transistor and the first power source; and a fourth transistor coupled between a first electrode of the first driving transistor and the bias power source, the fourth transistor being turned on when the third control signal is supplied to the third control line.

The compensation circuit may include a fifth transistor coupled between the first node and the second electrode of the first driving transistor, the fifth transistor being turned on when the second control signal is supplied to the second control line; a sixth transistor coupled between the first node and the initialization power source, the sixth transistor being turned on when the first control signal is supplied to the first control line; a seventh transistor coupled between the first power source and the first electrode of the first driving transistor, the seventh transistor being turned off when an emission control signal is supplied to an emission control line and turned on when the emission control signal is not supplied to the emission control line; and a second capacitor coupled between the first node and the first power source.

The initialization power source may be set to a voltage lower than a voltage of the first power source. The sixth and fifth transistors may progressively be turned on during a compensation period between frames, and the fourth transistor is set to a turn-on state during the compensation period. The seventh transistor may be set in a turn-off state during the compensation period and is set in a turn-on state during the frame after the compensation period.

In accordance with another embodiment, an organic light emitting display device may include pixels positioned in an area defined by scan lines and data lines; a bias power supply configured to supply a bias power source to the pixels; and a control driver configured to supply first, second, and third control signals respectively to first, second, and third control lines. Each pixel may include an organic light emitting diode; a first driving transistor configured to supply current from a first power source to the organic light emitting diode, the first driving transistor to supply the current corresponding to a voltage applied to a first node; a second driving transistor coupled between a second electrode of the first driving transistor and the organic light emitting diode, the second driving transistor being turned on or turned off corresponding to a data signal supplied from a data line; a third transistor coupled between a gate electrode of the second driving transistor and the data line, the third transistor being turned on when a scan signal is supplied to a scan line; and a compensation circuit coupled to the first node, the compensation circuit compensating for a voltage corresponding to a threshold voltage of the first driving transistor.

The bias power supply may supply different bias power voltages to red, green, and blue pixels that generate red light, green light and blue light, respectively. A scan driver may be configured to supply a scan signal to the scan lines; and a data driver may be configured to supply a data signal to the data lines.

One frame may be divided into a plurality of subfields, and the scan driver may supply the scan signal to the scan lines every scan period of the plurality of subfields.

The data driver may supply a first data signal to cause the pixel to emit light or a second data signal to cause the pixel not to emit light, one of the first data signal or the second data signal supplied to each data line in synchronization with the scan signal.

Each pixel may include a first capacitor coupled to the gate electrode of the second driving transistor and the first power source; and a fourth transistor coupled between a second node of the compensation circuit and the bias power source, the fourth transistor being turned on when the third control signal is supplied to the third control line.

The compensation circuit may include a fifth transistor coupled between the second node and the second electrode of the first driving transistor, the fifth transistor being turned on when a second control signal is supplied to a second control line; a sixth transistor coupled between the second node and an initialization power source, the sixth transistor being turned on when a first control signal is supplied to a first control line; a seventh transistor coupled between the third node and a reference power source, the seventh transistor being turned on when the second control signal is supplied to the second control line; and a second capacitor coupled between the first and second nodes. The compensation circuit may include a third capacitor coupled between the second node and the first power source.

The reference power source may be set to a voltage higher than a voltage of the bias power source. The reference power source may be the first power source. The initialization power source may be set to a voltage lower than a voltage of the first power source.

The control driver may progressively supply the first and second control signals during a compensation period between frames, and may supply the third control signal during the frame.

Each pixel further may include a first capacitor coupled between the gate electrode of the second driving transistor and the first power source; and a fourth transistor coupled between a first electrode of the first driving transistor and the bias power source, the fourth transistor being turned on when the third control signal is supplied to the third control line.

The compensation circuit may include a fifth transistor coupled between the first node and the second electrode of the first driving transistor, the fifth transistor being turned on when the second control signal is supplied to the second control line; a sixth transistor coupled between the second node and the initialization power source, the sixth transistor being turned on when the first control signal is supplied to the first control line; a seventh transistor coupled between the first power source and the first electrode of the first driving transistor, the seventh transistor being turned off when an emission control signal is supplied to an emission control line and turned on when the emission control signal is not supplied to the emission control line; and a second capacitor coupled between the first node and the first power source.

The initialization power source may be set to a voltage lower than a voltage of the first power source.

The control driver may progressively supply the first and second control signals during a compensation period between frames, and may supply the third control signal to overlap with the first and second control signals during the compensation period, and the control driver supplies the emission control signal during the compensation period and does not supply the emission control signal during the frame after the compensation period.

A fourth transistor may be coupled between the bias power source and a plurality of compensation circuits included in each pixel, the fourth transistor being turned on when the third control signal is supplied to the third control line.

A seventh transistor may be coupled between the reference power source and a plurality of compensation circuits included in each pixel, the seventh transistor being turned on when the second control signal is supplied to the second control line.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
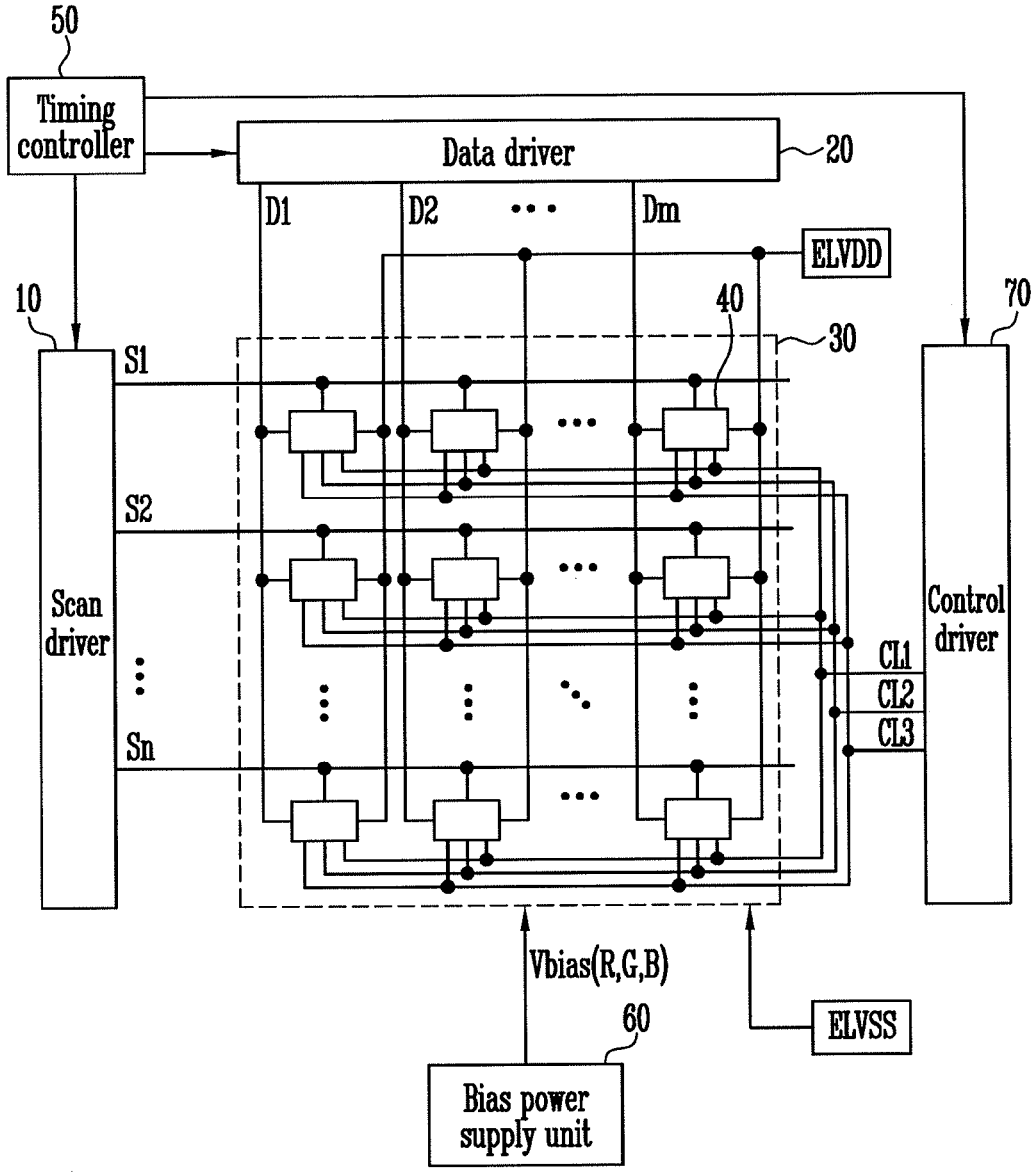
FIG. 1 illustrates an embodiment of an organic light emitting display.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 is a block diagram illustrating an embodiment of an organic light emitting display which includes a pixel unit 30 containing a plurality of pixels 40 positioned in an area defined by scan lines S1 to Sn and data lines D1 to Dm. The display further includes a scan driver 10 configured to drive the scan lines S1 to Sn, a data driver 20 configured to driver the data lines D1 to Dm, a bias power supply unit 60 configured to supply a bias power source Vbias(R, G, B) to the pixels 40, a control driver 70 configured to drive control lines CL1 to CL3, and a timing controller 50 configured to control the scan driver 10, the data driver 20 and the control driver 70.

The pixels 40 receive voltages from a first power source ELVDD and a second power source ELVSS. The pixels 40 emit light corresponding to a data signal. The light corresponds to a predetermined gray scale value within a range of predetermined grayscale values. Each pixel includes an organic light emitting diode. The current supplied to the organic light emitting diode is determined by the voltage of a bias power source Vbias(R, G, B) during a period in which the pixels 40 are set in an emission state. The pixels may be controlled to be set in an emission state and a non-emission state.

To this end, each pixel 40 includes a first driving transistor and a second driving transistor. The first driving transistor controls the amount of current flowing through an organic light emitting diode from the first power source ELVDD, corresponding to the voltage of the bias power source Vbias(R, G, B). The second driving transistor controls the electrical coupling between the first driving transistor and the organic light emitting diode while being turned on or turned off, corresponding to the data signal.

The bias power supply unit 60 supplies the bias power source Vbais(R, G, B) to each pixel 40. The voltage of the bias power source Vbais(R, G, B) may be determined so that the pixels 40 generate light with a predetermined luminance. For example, the voltage of the bias power source Vbais(R, G, B) may be determined so that light with a luminance corresponding to the maximum gray scale value (e.g., white) is generated during a period in which the pixel 40 emits the light.

Meanwhile, the pixels 40 configured to generate red, green and blue light may generate light with different luminances, corresponding to the same bias power source Vbias. Thus, the bias power supply unit 60 supplies a red bias power source Vbias(R) to the pixel 40 configured to generate red light, supplies a green bias power source Vbias(G) to the pixel 40 configured to generate green light, and supplies a blue bias power source Vbias(B) to the pixel 40 configured to generate blue light. The voltage of each of the red bias power source Vbias(R), the green bias power source Vbias(G), and the blue bias power source Vbias(B) may be determined so that light corresponding to the maximum gray scale value is generated from each pixel 40.

The scan driver 10 supplies a scan signal to the scan lines S1 to Sn every scan period of a plurality of subfields included in one frame. If the scan signal is supplied to the scan lines S1 to Sn, pixels 40 are selected for each horizontal line.

The data driver 20 supplies a data signal to the data lines D1 to Dm so as to be synchronized with the scan signal. The data driver 20 supplies, to each of the data lines D1 to Dm, a first data signal with which the pixels 40 emit light or a second data signal with which the pixels 40 do not emit light. The pixels 40 receiving the first data signal during a scan period are set in an emission state during an emission period after the scan period.

The control driver 70 drives first, second and third control lines CL1, CL2 and CL3 commonly coupled to the pixels 40. For example, the control driver 70 sequentially supplies first and second control signals to the respective first and second control lines CL1 and CL2 during a compensation period between frames. The control driver 70 supplies a third control signal to the third control line CL3 during the frame.

The timing controller 50 controls the scan driver 10, the data driver 20, and the control driver 70 based on synchronization signals, which may be supplied, for example, from an external source of the organic light emitting display.

Figure 2:
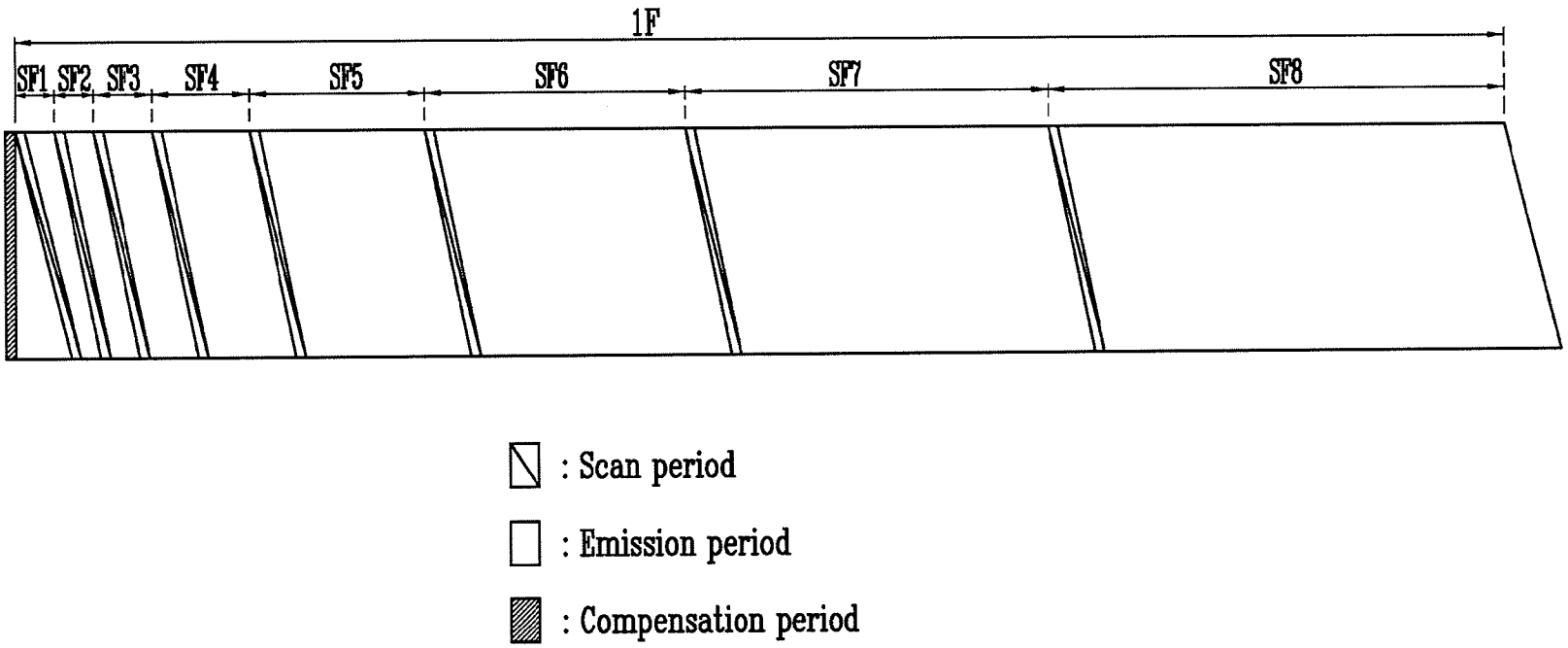
FIG. 2 illustrates a frame for driving an organic light emitting display.

FIG. 2 illustrates an embodiment of one frame for driving the display. Although the frame is shown to include eight subfields SF1 to SF8, a different number of subfields may be included in other embodiments.

Referring to FIG. 2, the frame is divided into a plurality of subfields SF1 to SF8. Each of the subfields SF1 to SF8 is divided into a scan period and an emission period. During the scan period, a scan signal is supplied to the scan lines S1 to Sn and a data signal synchronized with the scan signal is supplied to the data lines D1 to Dm. Thus, a voltage corresponding to the first or second data signal is charged in each pixel 40 during the scan period.

In the emission period, pixels 40 receiving the first data signal supplied during the scan period emit light. Meanwhile, the emission periods of the subfields SF1 to SF8 are set identical and/or different so that a predetermined gray scale value can be implemented. That is, pixels 40 may emit light with a predetermined gray scale value corresponding to the emission period of the one frame.

Additionally, the frame includes a compensation period which, for example, may be included at a front end of the first subfield SF1, i.e., between frames. The threshold voltage of the first driving transistor included in each pixel 40 is compensated in the compensation period.

Figure 3:
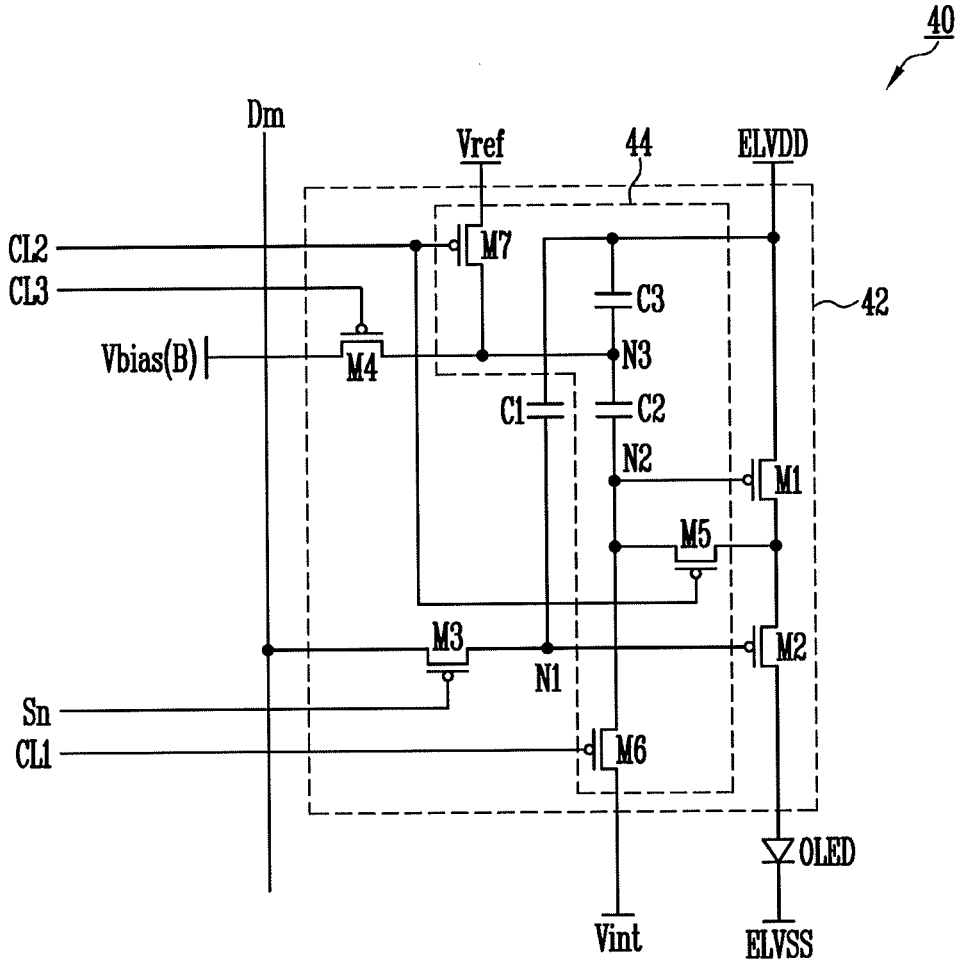
FIG. 3 illustrates a first embodiment of a pixel.

FIG. 3 illustrates a first embodiment of a pixel, which, for convenience of illustration, is shown to be coupled to an m-th data line Dm and an n-th scan line Sn. Referring to FIG. 3, the pixel 40 according to this embodiment includes an organic light emitting diode OLED and a pixel circuit 42 configured to supply current to the organic light emitting diode OLED.

The organic light emitting diode OLED is set in an emission state when the current is supplied from the pixel circuit 42. The organic light emitting diode OLED is set in a non-emission state when the current is not supplied from the pixel circuit 42.

The pixel circuit 42 supplies or cuts off a predetermined current corresponding to the voltage of the bias power source Vbias(B) to or from the organic light emitting diode OLED, corresponding to a data signal. To this end, the pixel circuit 42 includes a compensation unit 44, first to fourth transistors M1 to M4, and a first capacitor C1.

A first electrode of the first transistor (first driving transistor) M1 is coupled to the first power source ELVDD, and a second electrode of the first transistor M1 is coupled to a first electrode of the second transistor M2. A gate electrode of the first transistor M1 is coupled to a second node N2 of the compensation unit 44. The first transistor M1 controls the amount of current supplied from the first power source ELVDD to the organic light emitting diode OLED via the second transistor M2, corresponding to a voltage applied to the second node N2.

The voltage applied to the second node N2 is determined by the threshold voltage of the first transistor M1 and the voltage of the bias power source Vbias(B). The voltage of the bias power source Vbias(B) is set so that current corresponding to the maximum gray scale value can be supplied to the organic light emitting diode OLED. In this case, the first transistor M1 supplying, to the organic light emitting diode OLED, the current corresponding to the bias power source Vbias(B) is driven in a saturation region. That is, the first transistor M1 is driven as a current source configured to supply a predetermined current, corresponding to the voltage of the bias power source Vbias(B).

The first electrode of the second transistor (second driving transistor) M2 is coupled to the second electrode of the first transistor M1, and a second electrode of the second transistor M2 is coupled to an anode electrode of the organic light emitting diode OLED. A gate electrode of the second transistor M2 is coupled to a first node N1.

The second transistor M2 is turned on or turned off, corresponding to the voltage at the first node N1. In other words, the second transistor M2 is set in a turn-on state when the first data signal is supplied to the first node N1, and is set in a turn-off state when the second data signal is supplied to the first node N1. That is, the second transistor M2 is driven as a switch in a linear region.

When the second transistor M2 is set in the turn-on state, the organic light emitting diode OLED is coupled to the first transistor M1 driven as the current source. That is, when the second transistor M2 is set in the turn-on state, the organic light emitting diode OLED is not directly coupled to a voltage source ELVDD, but is coupled to the first transistor M1 driven as the current source. In this case, the degradation of the organic light emitting diode OLED is minimized and, accordingly, it is possible to improve the lifespan of the organic light emitting diode OLED.

In other words, in the case where the organic light emitting diode OLED is coupled to the voltage source in digital driving method, degradation of the organic light emitting diode OLED may rapidly occur. However, in accordance with one embodiment, the organic light emitting diode OLED is driven corresponding to current supplied from the current source M1. Hence, it is possible to decrease the speed at which the organic light emitting diode OLED is degraded. Although the organic light emitting diode OLED is degraded, the amount of current supplied from the first transistor M1 may be maintained at a constant level, thereby implementing an image with a desired luminance.

A first electrode of the third transistor M3 is coupled to the data line Dm, and a second electrode of the third transistor M3 is coupled to the first node N1. A gate electrode of the third transistor M3 is coupled to the scan line Sn. The third transistor M3 is turned on when a scan signal is supplied to the scan line Sn so as to supply the data signal from the data line to the first node N1.

A first electrode of the fourth transistor M4 is coupled to the bias power source Vbias(B), and a second electrode of the fourth transistor M4 is coupled to a third node N3 of the compensation unit 44. A gate electrode of the fourth transistor M4 is coupled to the third control line CL3. The fourth transistor M4 is turned on when the third control signal is supplied to the third control line CL3 so as to supply the voltage of the bias power source Vbias(B) to the third node N3.

The first capacitor C1 is coupled between the first power source ELVDD and the first node N1. The first capacitor C1 stores a voltage corresponding to the first or second data signal.

The compensation unit 44 compensates for the threshold voltage of the first transistor M1 during the compensation period. To this end, the compensation unit 44 includes fifth to seventh transistors M5 and M7, a second capacitor C2, and a third capacitor C3.

A first electrode of the fifth transistor M5 is coupled to the second electrode of the first transistor M1, and a second electrode of the fifth transistor M5 is coupled to the second node N2. A gate electrode of the fifth transistor M5 is coupled to the second control line CL2. The fifth transistor M5 is turned on when the second control signal is supplied to the second control line CL2 so as to allow the second electrode of the first transistor M1 and the second node N2 to be electrically coupled to each other. That is, if the fifth transistor M5 is turned on, the first transistor M1 is diode-coupled.

A first electrode of the sixth transistor M6 is coupled to the second node N2, and a second electrode of the sixth transistor M6 is coupled to an initialization power source Vint. A gate electrode of the sixth transistor M6 is coupled to the first control line CL1. The sixth transistor M6 is turned on when the first control signal is supplied to the first control line CL1 so as to supply the voltage of the initialization power source Vint to the second node N2. The initialization power source Vint may be set to a voltage lower than that of the first power source ELVDD.

Figure 4:
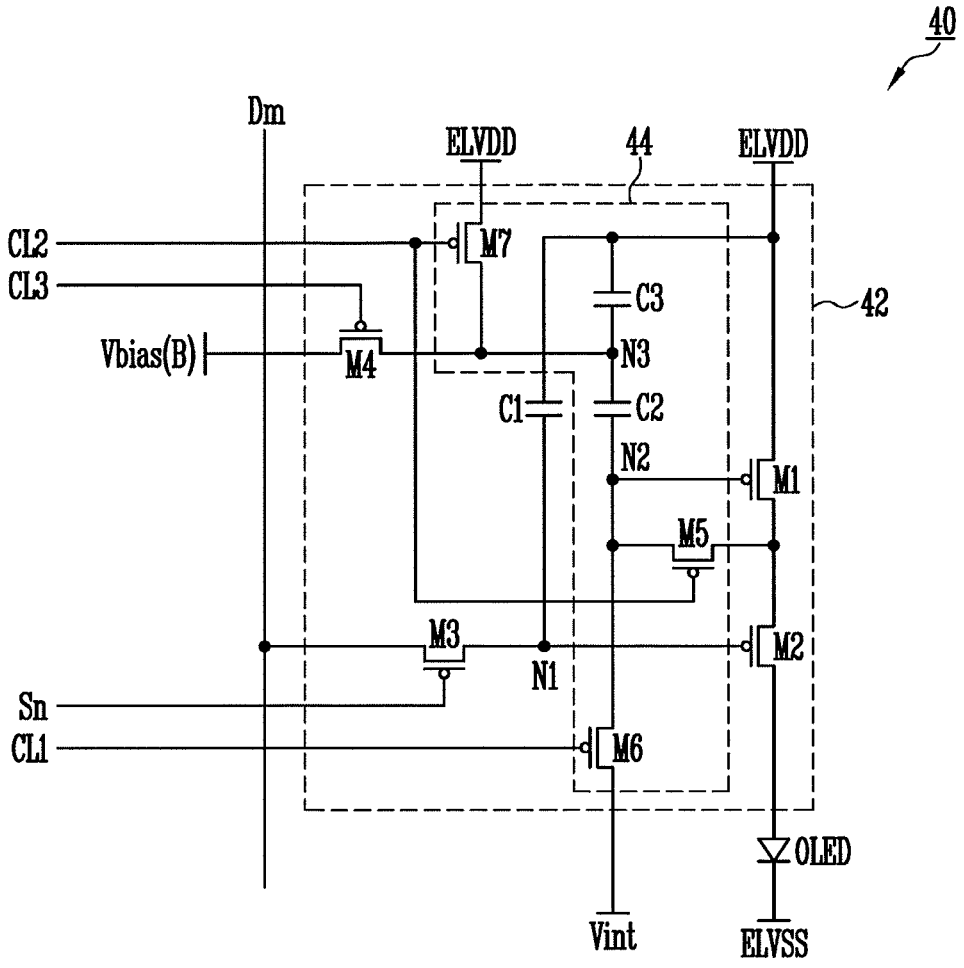
FIG. 4 illustrates an embodiment of a reference power source in FIG. 3.

The seventh transistor M7 is coupled between a reference power source Vref and the third node N3. A gate electrode of the seventh transistor M7 is coupled to the second control line CL2. The seventh transistor M7 is turned on when the second control signal is supplied to the second control line CL2 so as to supply the voltage of the reference power source Vref to the third node N3. The reference power source Vref may be set to a voltage higher than that of the bias power source Vbias(B). For example, the reference power source Vref may be set as the first power source ELVDD as shown in FIG. 4.

The second capacitor C2 is coupled between the third and second nodes N3 and N2. The second capacitor C2 charges a voltage corresponding to the threshold voltage of the first transistor M1.

The third capacitor C3 is coupled between the first power source ELVDD and the third node N3. The third capacitor C3 charges to a predetermined voltage corresponding to the voltage of the bias power source Vbias(B).

In one embodiment, some transistors in the pixel may be set to be coupled to a plurality of pixels. For example, as shown in FIGS. 5A to 5C, at least one of fourth and seventh transistors M4' and MT may be formed to be coupled to a plurality of pixels 40.

Figure 5A:
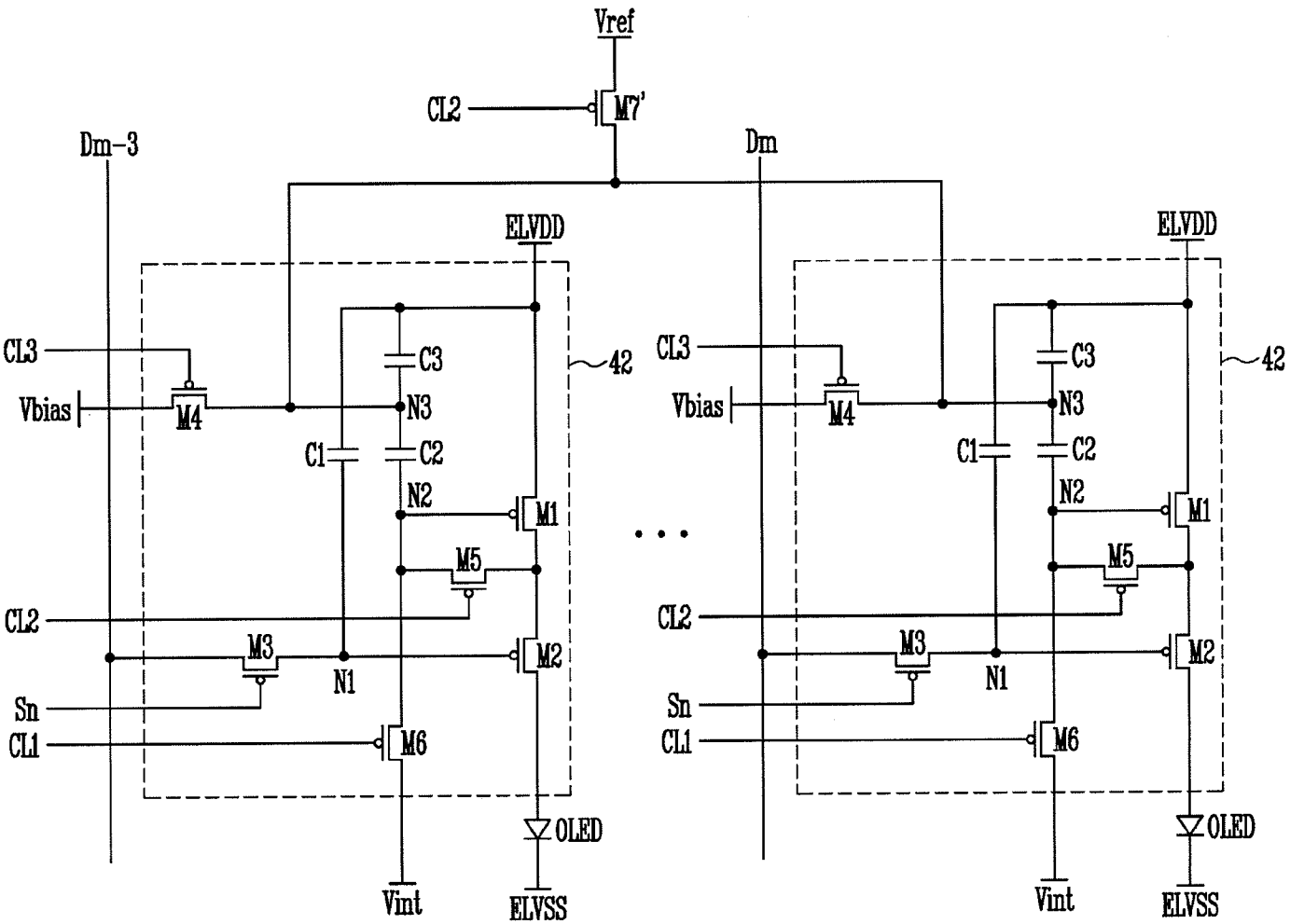
FIGS. 5A to 5C illustrates embodiments in which some transistors in FIG. 3 are commonly coupled to pixels.

As shown in FIG. 5A, a first electrode of the seventh transistor M7' is coupled to the reference power source Vref, and a second electrode of the seventh transistor MT is commonly coupled to the third node N3 of the pixels 40. In a case where the seventh transistor MT is formed to be coupled to a plurality of pixels 40, the structure of the pixel 40 is simplified.

Figure 5B:
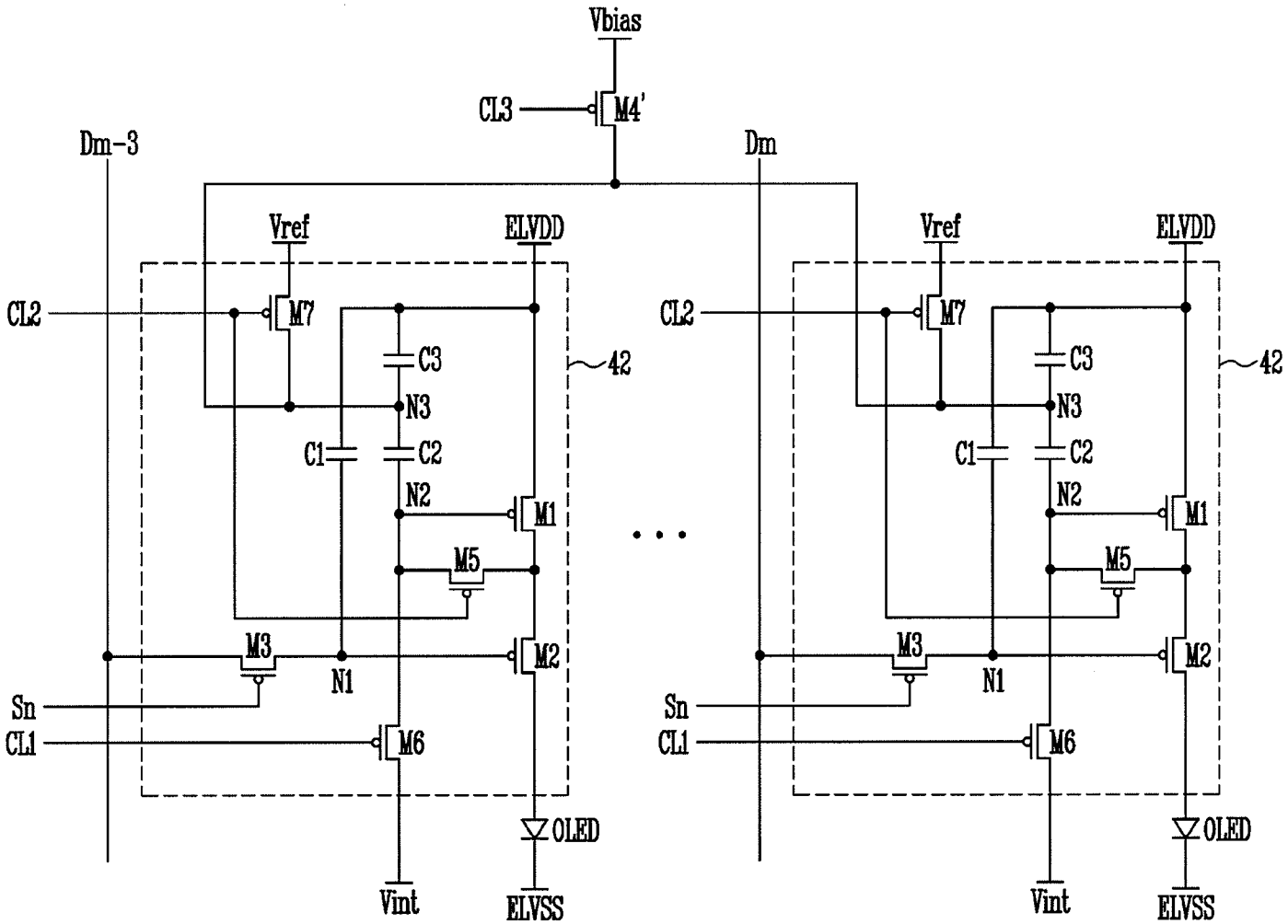
Figure 5C:
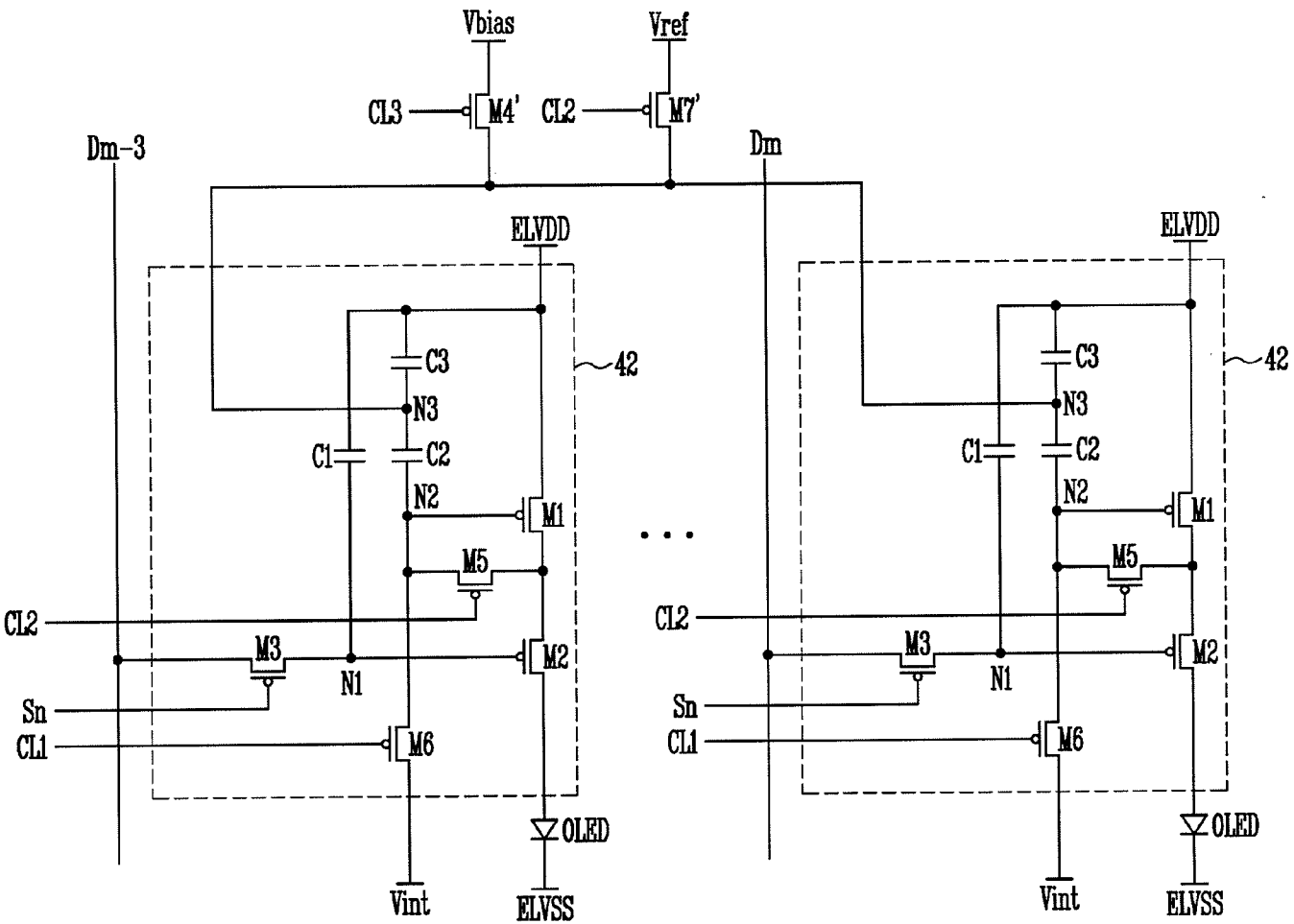

As shown in FIG. 5B, a first electrode of the fourth transistor M4' is coupled to the bias power source Vbias(B), and a second electrode of the fourth transistor M4' is commonly coupled to the third node N3 of the pixels 40. In a case where the fourth transistor M4' is formed to be coupled to a plurality of pixels 40 as described above, the structure of the pixel 40 is simplified. Similarly, in the present embodiment, the fourth and seventh transistors M4' and MT may be formed to be coupled to a plurality of pixels 40 as shown in FIG. 5C.

Figure 6:
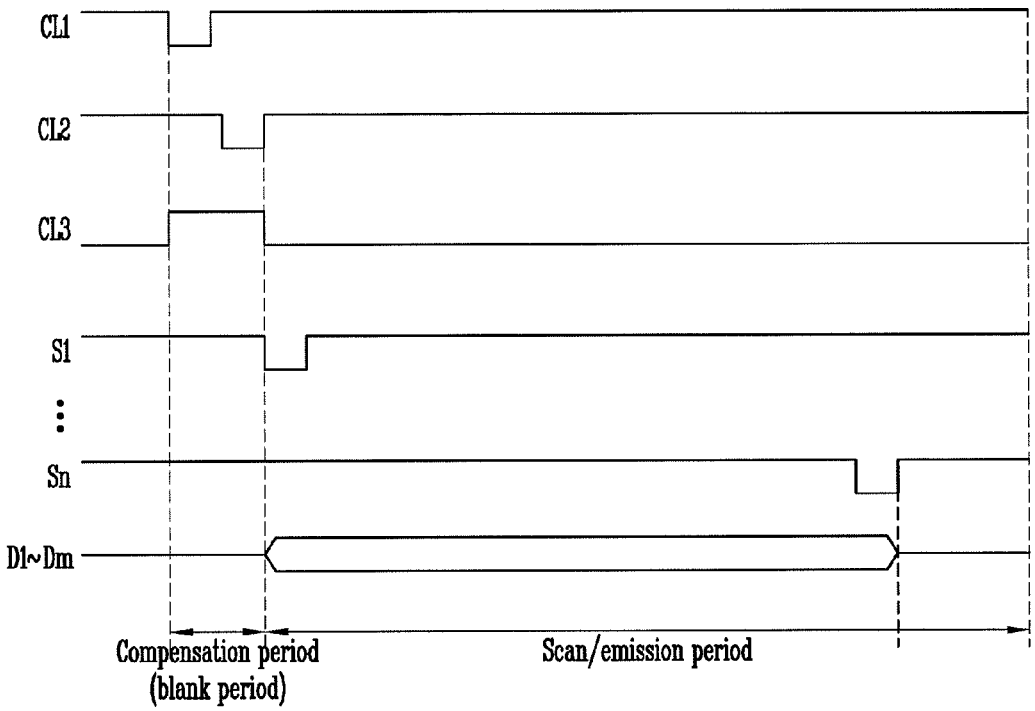
FIG. 6 illustrates one embodiment of a waveform of a driving method of the pixel in FIG. 3.

FIG. 6 illustrates an embodiment of a waveform of a method for driving the pixel shown in FIG. 3. Referring to FIG. 6, a first control signal is first supplied to the first control line CL1 during a compensation period positioned between frames, e.g., a blank period. If the first control signal is supplied to the first control line CL1, the sixth transistor M6 is turned on. If the sixth transistor M6 is turned on, the voltage of the initialization power source Vint is applied to the second node N2.

Subsequently, a second control signal is supplied to the second control line CL2. If the second control signal is supplied to the second control line CL2, the fifth and seventh transistors M5 and M7 are turned on.

If the seventh transistor M7 is turned on, the voltage of the reference power source Vref, e.g., the voltage of the first power source ELVDD is applied to the third node N3. If the fifth transistor M5 is turned on, the first transistor M1 is diode-coupled. In this case, the voltage at the second node N2 is initialized as the voltage of the initialization power source Vint, and hence the first transistor M1 is turned on. If the first transistor M1 is turned on, the voltage at the second node N2 is set to a voltage obtained by subtracting the absolute threshold voltage of the first transistor M1 from the voltage of the first power source ELVDD. In this case, the second capacitor C2 charges a voltage corresponding to the difference between the voltages at the third and second nodes N3 and N2, i.e., the threshold voltage of the first transistor M1.

The first and second control lines CL1 and CL2 are commonly coupled to the pixels 40 of the pixel unit 30. Thus, a voltage corresponding to the threshold voltage of the first transistor M1 is charged in the second capacitor C2 included in each pixel 40 during the compensation period.

Subsequently, the pixels 40 generate light with a predetermined luminance by passing through the scan and emission periods of the plurality of subfields SF1 to SF8 included in the one frame 1F.

Specifically, a third control signal is supplied to the third control line CL3 during the one frame 1F. If the third control signal is supplied to the third control line CL3, the fourth transistor M4 is turned on. If the fourth transistor M4 is turned on, the voltage of the bias power source Vbias(B) is applied to the third node N3. If the voltage of the bias power source Vbias(B) is applied to the third node N3, the voltage at the third node N3 is dropped from the voltage of the reference power source Vref to the voltage of the bias power source Vbias(B). In this case, the third capacitor C3 charges a voltage corresponding to the voltage applied to the third node N3, i.e., the voltage of the bias power source Vbias(B).

If the voltage at the third node N3 is dropped, the voltage at the second node N2 is dropped by coupling of the second capacitor C2. If the voltage at the second node N2 is dropped, the first transistor M1 is driven as a current source, corresponding to the voltage applied to the second node N2.

Subsequently, a scan signal is progressively supplied to the scan lines S1 to Sn during the scan period of each of the subfields SF1 to SF8 corresponding to a gray scale value to be implemented. A first or second data signal is supplied to each of the data lines D1 to Dm, corresponding to the scan signal.

If the scan signal is supplied to the n-th scan line Sn, the third transistor M3 is turned on. If the third transistor M3 is turned on, the data line Dm and the first node N1 are electrically coupled to each other. Then, the first or second data signal from the data line Dm is supplied to the first node N1, and the first capacitor C1 charges a voltage corresponding to the voltage at the first node N1.

Subsequently, the second transistor M2 is turned on or turned off corresponding to the data signal. If the second transistor M2 is turned on, a predetermined current from the first transistor M1 is supplied to the organic light emitting diode OLED. As a result, the organic light emitting diode OLED is set in an emission state. If the second transistor M2 is turned off, the current is not supplied to the organic light emitting diode OLED. As a result, the organic light emitting diode OLED is set in a non-emission state.

As described above, in accordance with one embodiment, the first transistor M1 is driven in the saturation region and the second transistor M2 is driven in the linear region. In a case where the first transistor M1 is driven in the saturation region, the first transistor M1 is driven as a current source. Accordingly, it is possible to constantly maintain the amount of current supplied to the organic light emitting diode OLED, thereby preventing luminance from being lowered by degradation of the organic light emitting diode OLED. In a case where the second transistor M2 is driven in the linear region, the delay caused by charging/discharging of the data signal is minimized. Accordingly, it is possible to improve the driving speed of the organic light emitting diode OLED.

Figure 7:
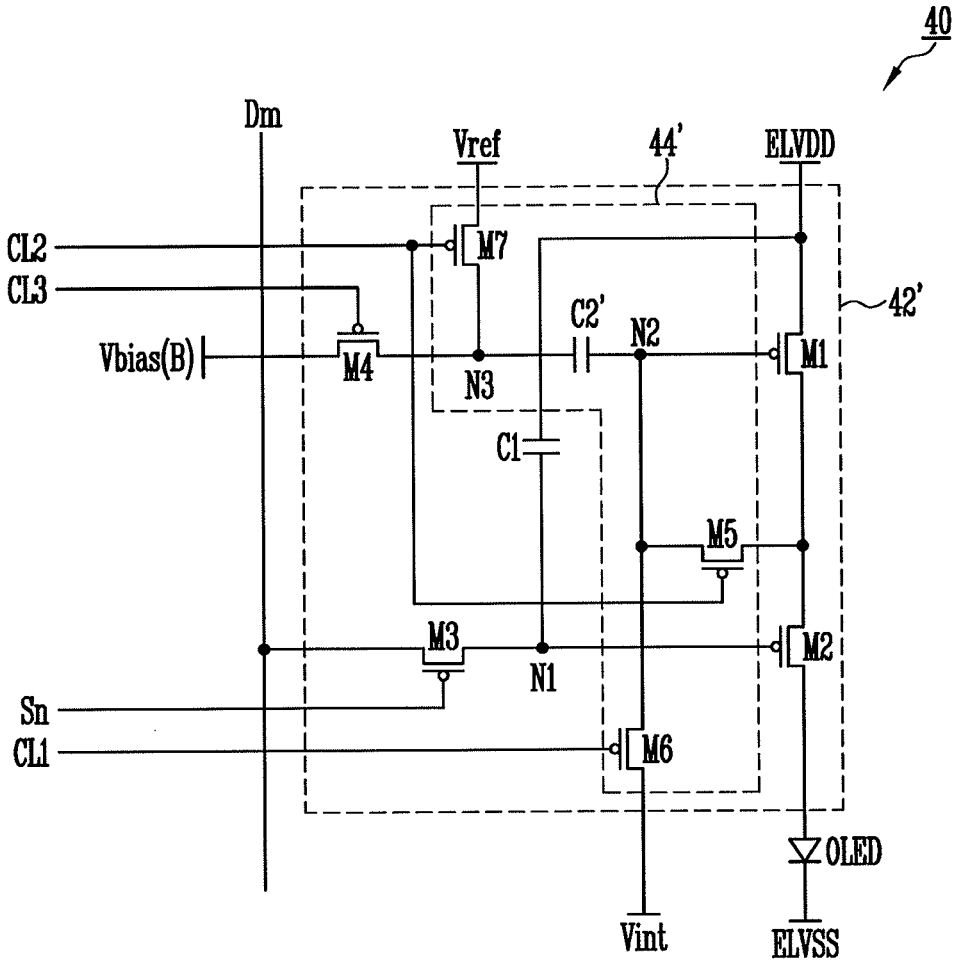
FIG. 7 illustrates a second embodiment of a pixel.

FIG. 7 illustrates a second embodiment of a pixel 40. In FIG. 7, components identical to those of FIG. 3 are designated by like reference numerals, and their detailed descriptions will be omitted.

Referring to FIG. 7, the pixel 40 includes an organic light emitting diode OLED and a pixel circuit 42' configured to supply current to the organic light emitting diode OLED. The pixel circuit 42' includes a compensation unit 44', first to fourth transistors M1 to M4, and a first capacitor C1.

The compensation unit 44' compensates for the threshold voltage of the first transistor M1 during a compensation period. To this end, the compensation unit 44' includes fifth to seventh transistor M7 and a second capacitor C2'.

The second capacitor C2' is coupled between the second and third nodes N2 and N3. The second capacitor CT stores a voltage corresponding to the threshold voltage of the first transistor M1 and the voltage of the bias power source Vbias(B). That is, the third capacitor C3 shown in FIG. 3 is removed in the pixel 40 according to this embodiment.

FIGS. 6 and 7 describe the operation of the pixel 40 according to this embodiment. The sixth transistor M6 is turned on, corresponding to the first control signal supplied to the first control line CL1 during the compensation period. If the sixth transistor M6 is turned on, the voltage of the initialization power source Vint is supplied to the second node N2.

Subsequently, the second control signal is supplied to the second control line CL2 so that the fifth and seventh transistors M5 and M7 are turned on. If the seventh transistor M7 is turned on, the voltage of the reference power source Vref, e.g. the voltage of the first power source ELVDD to the third node N3. If the fifth transistor M5 is turned on, the first transistor M1 is diode-coupled. In this case, the first transistor M1 is turned on so that the voltage at the second node N2 is set as a voltage obtained by subtracting the absolute threshold voltage of the first transistor M1 from the voltage of the first power source ELVDD. In this case, the second capacitor CT charges a voltage corresponding to the difference between the voltages at the third and second nodes N3 and N2, i.e., a voltage corresponding to the threshold voltage of the first transistor M1.

Subsequently, the pixels 40 generate light with a predetermined luminance by passing through the scan and emission periods of the plurality of subfields SF1 to SF8 included in the one frame 1F.

The third control signal is supplied to the third control line CL3 during the one frame 1F so that the fourth transistor M4 is turned on. If the fourth transistor M4 is turned on, the voltage of the bias power source Vbias(B) is supplied to the third node N3. If the voltage of the bias power source Vbias(B) is supplied to the third node N3, the voltage at the third node N3 is dropped from the voltage of the reference power source Vref to the voltage of the bias power source Vbias(B). In this case, the voltage at the second node N2 is dropped by coupling of the second capacitor C2'. If the voltage at the second node N2 is dropped, the first transistor M1 is driven as a current source, corresponding to the voltage applied to the second node N2.

The second capacitor C2' maintains the voltage at the second node N2. Subsequently, a scan signal is progressively supplied to the scan lines S1 to Sn during the scan period of each of the subfields SF1 to SF8, corresponding to a gray scale value to be implemented. Also, a first or second data signal is supplied to each of the data lines D1 to Dm, corresponding to the scan signal.

If the scan signal is supplied to the n-th scan line Sn, the third transistor M3 is turned on. If the third transistor M3 is turned on, the data line Dm and the first node N1 is electrically coupled to each other. Then, the first or second signal from the data line Dm is supplied to the first node N1, and the capacitor C1 charges a voltage corresponding to the voltage at the first node N1.

Subsequently, the second transistor M2 is turned on or turned off, corresponding to the data signal. If the second transistor M2 is turned on, a predetermined current is supplied from the first transistor M1 to the organic light emitting diode OLED. As a result, the organic light emitting diode OLED is set in an emission state. If the second transistor M2 is turned off, the current is not supplied to organic light emitting diode OLED. As a result, the organic light emitting diode OLED is set in a non-emission state.

Figure 8:
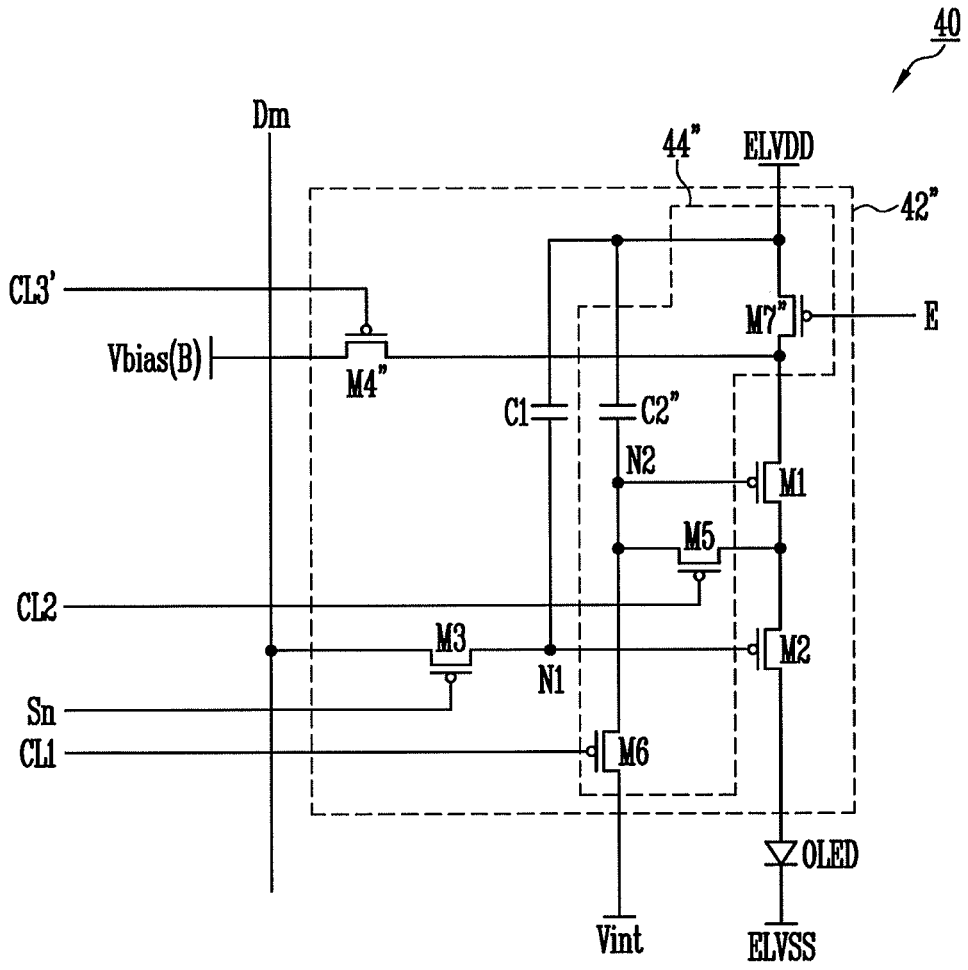
FIG. 8 illustrates a third embodiment of a pixel.

FIG. 8 illustrates a third embodiment of a pixel 40. In FIG. 8, components identical to those of FIG. 3 are designated by like reference numerals, and their detailed descriptions will be omitted.

Referring to FIG. 8, the pixel 40 includes an organic light emitting diode OLED and a pixel circuit 42" configured to supply current to the organic light emitting diode OLED. The pixel circuit 42" includes a compensation unit 44", first to fourth transistors M1 to M4" and a first capacitor C1.

The fourth transistor M4" is coupled between the bias power source Vbias(B) and a first electrode of the first transistor M1. The fourth transistor M4" is turned on when the third control signal is supplied to the third control line CL3 so as to supply the voltage of the bias power source Vbias(B) to the first electrode of the first transistor M1.

The compensation unit 44" compensates for the threshold voltage of the first transistor M1 during the compensation period. To this end, the compensation unit 44" includes fifth to seventh transistors M5 to MT and a second capacitor C2".

A first electrode of the seventh transistor M7" is coupled to the first power source ELVDD, and a second electrode of the seventh transistor M7" is coupled to the first electrode of the first transistor M1. A gate electrode of the seventh transistor M7" is coupled to the emission control line E. The seventh transistor M7" is turned off when the emission control signal is supplied to the emission control line E, and is turned on when the emission control signal is not supplied to the emission control line E.

The emission control line E coupled to the gate electrode of the seventh transistor MT is commonly coupled to the pixels 40. The control driver 70 supplies the emission control signal to the emission control line E during the compensation period, and does not supply the emission control signal to the emission control line E during the one frame.

The second capacitor C2" is coupled between the second node N2 and the first power source ELVDD. The second capacitor C2" stores a voltage corresponding to the threshold voltage of the first transistor M1 and the voltage of the bias power source Vbias(B).

Additionally, in the pixel 40 according to this embodiment, the fourth and seventh transistors M4" and MT may be coupled to a plurality of pixels as described with reference to FIGS. 5A to 5C.

Figure 9:
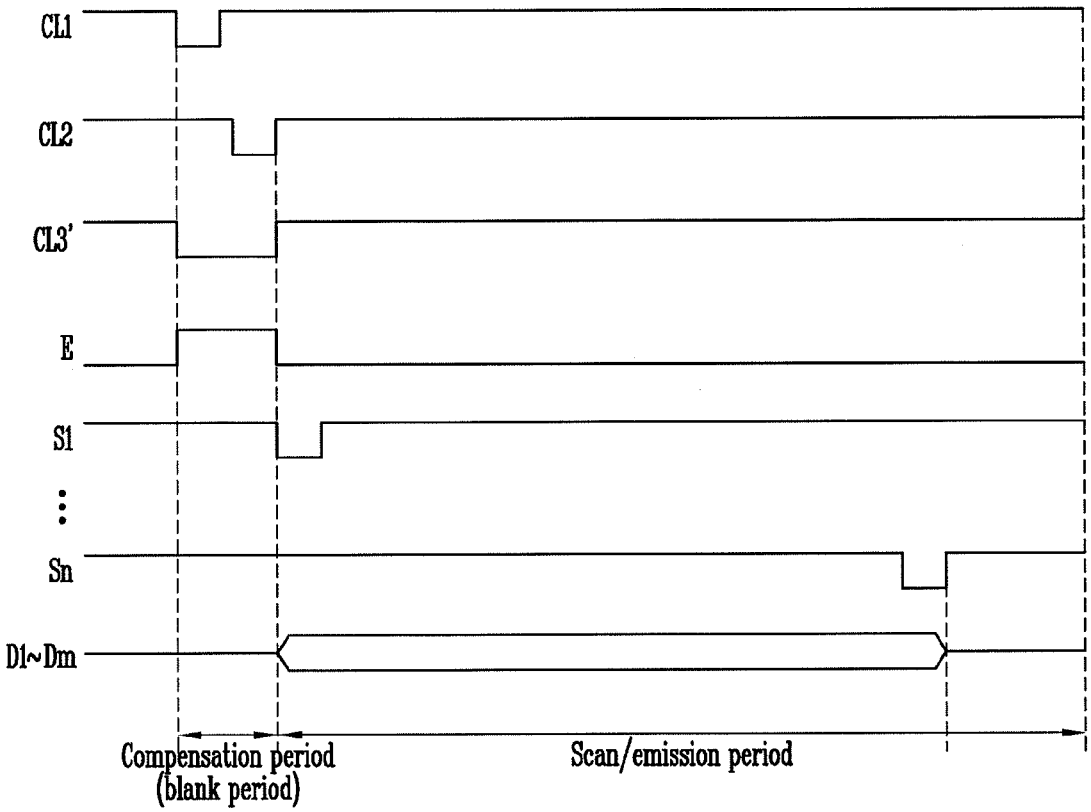
FIG. 9 illustrates an embodiment of a waveform of a driving method of the pixel in FIG. 8.

FIG. 9 illustrates a waveform corresponding to an embodiment of a method for driving the pixel shown in FIG. 8. Referring to FIG. 9, during the compensation period, first and second control signals are progressively supplied to the respective first and second control lines CL1 and CL2. In addition, a third control signal and an emission control signal are respectively supplied to a third control line CL3' and the emission control line E so as to overlap with the first and second control signals.

If the emission control signal is supplied to the emission control line E, the seventh transistor M7" is turned off. If the first control signal is supplied to the first control line C1, the sixth transistor M6 is turned on. If the sixth transistor M6 is turned on, the voltage of the initialization power source Vint is supplied to the second node N2. If the third control signal is supplied to the third control line CL3', the voltage of the bias power source Vbias(B) is applied to the first electrode of the first transistor M1.

Subsequently, the second control signal is supplied to the second control signal CL2 so that the fifth transistor M5 is turned on. If the fifth transistor M5 is turned on, the first transistor M1 is diode-coupled. In this case, the voltage at the second node N2 is initialized as the voltage of the initialization power source Vint, and hence the first transistor M1 is turned on. If the first transistor M1 is turned on, the voltage at the second node N2 is set as a voltage obtained by subtracting the absolute threshold voltage of the first transistor M1 from the voltage of the bias power source Vbias (B). In this case, the second capacitor C2" charges a voltage corresponding to the voltage of the bias power source Vbias(B) and the threshold voltage of the first transistor M1.

Subsequently, the pixels 40 generate light with a predetermined luminance by passing through the scan and emission periods of the plurality of subfields SF1 to SF8 included in the one frame 1F. Specifically, the supply of the emission control signal to the emission control line E is stopped during the one frame 1 so that the seventh transistor M7" is turned on. If the seventh transistor M7" is turned on, the first power source ELVDD and the first electrode of the first transistor M1 are electrically coupled to each other. Then, the first transistor M1 is driven as a current source, corresponding to the voltage stored in the second capacitor C2".

Subsequently, a scan signal is progressively supplied to the scan lines S1 to Sn during the scan period of each of the subfields SF1 to SF8, corresponding to a gray scale value to be implemented. Also, a first or second data signal is supplied to each of the data lines D1 to Dm, corresponding to the scan signal.

If the scan signal is supplied to the n-th scan line Sn, the third transistor M3 is turned on. If the third transistor M3 is turned on, the data line Dm and the first node N1 are electrically coupled to each other. Then, the first or second data signal from the data line Dm is supplied to the first node N1, and the first capacitor C1 charges a voltage corresponding to the voltage at the first node N1.

Subsequently, the second transistor M2 is turned on or turned off, corresponding to the data signal. If the second transistor M2 is turned on, a predetermined current is supplied from the first transistor M1 to the organic light emitting diode OLED. As a result, the organic light emitting diode OLED is set in an emission state. If the second transistor M2 is turned off, the current is not supplied to the organic light emitting diode OLED. As a result, the organic light emitting diode OLED is set in a non-emission state.

Figure 10:
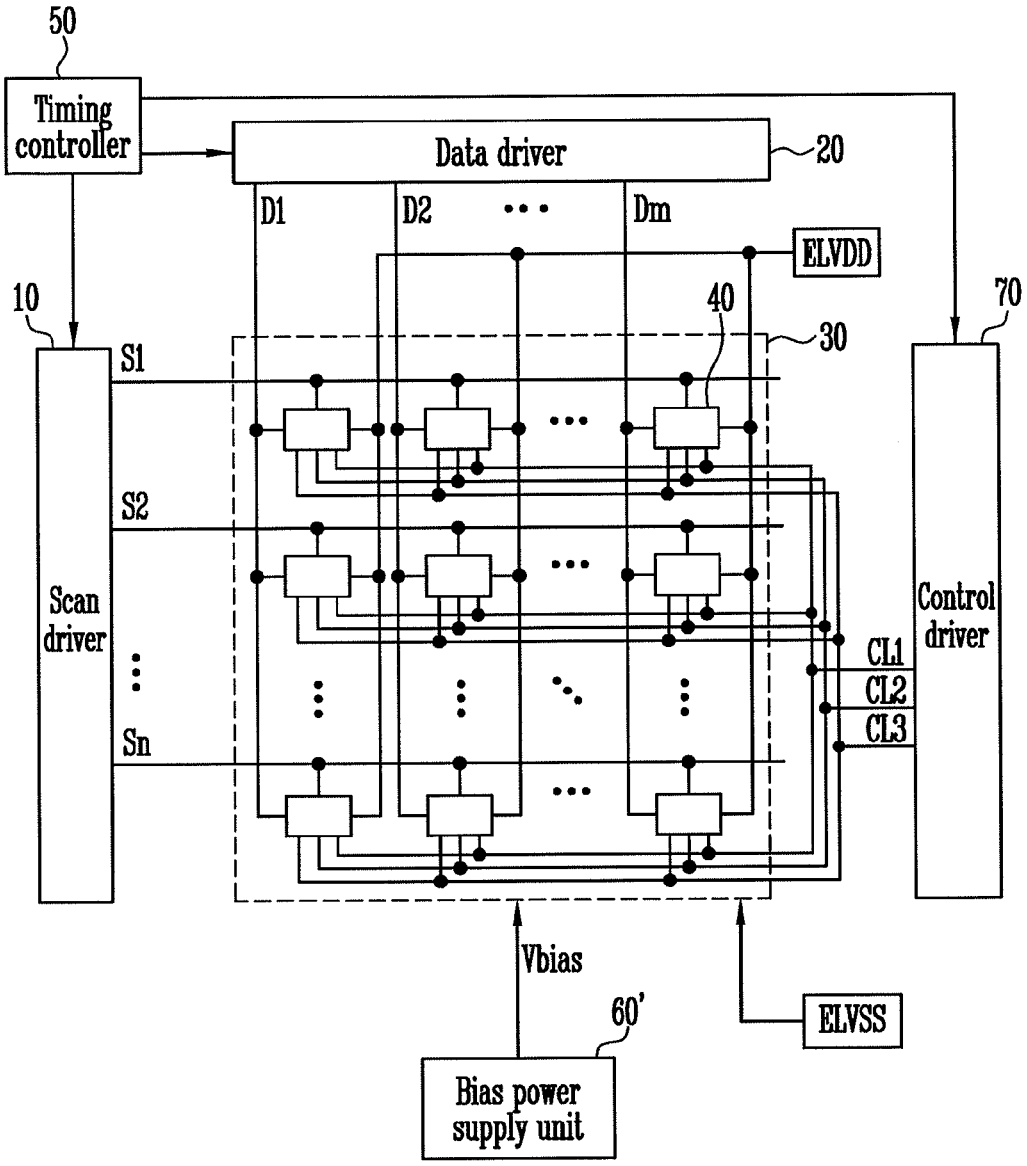
FIG. 10 illustrates another embodiment of an organic light emitting display.

FIG. 10 illustrates another embodiment of an organic light emitting display. In FIG. 10, components identical to those of FIG. 1 are designated by like reference numerals, and their detailed descriptions will be omitted.

Referring to FIG. 10, a bias power supply unit 60' of the organic light emitting display according to this embodiment supplies the same bias power source Vbias to all the pixels 40. In other words, the bias power supply unit 60' supplies the same bias power source Vbias to red, green and blue pixels 40. In this case, the number of signal lines for transmitting the bias power source Vbias is decreased, thereby improving the resolution of the organic light emitting display.

Although many of the transistors shown in the foregoing embodiments are PMOS transistors, the transistors may be formed as NMOS transistors or a combination of NMOS and PMOS transistors in other embodiments.

Also, in accordance with one or more embodiments, the organic light emitting diode OLED generates light of a specific color corresponding to the amount of current supplied from the driving transistor. However, in other embodiments, the organic light emitting diode OLED may generate white light corresponding to the amount of the current supplied from the driving transistor. In this case, a color image is implemented using a separate color filter or the like.

By way of summation and review, an organic light emitting display includes a plurality of pixels arranged in a matrix form at intersection portions of a plurality of data lines, a plurality of scan lines and a plurality of power lines. Each pixel generally includes an organic light emitting diode, two or more transistors including a driving transistor, and one or more capacitors. The organic light emitting display has low power consumption, but in some displays an image with a desired luminance cannot be displayed by degradation of the organic light emitting diode.

In the pixel and the organic light emitting display according to one or more of the foregoing embodiments, a gray scale value is implemented using the first driving transistor driven as a current source by a bias power source and the second driving transistor driven as a switch by a data signal. Here, the first driving transistor supplies constant current, regardless of degradation of the organic light emitting diode. Accordingly, it is possible to prevent a reduction in luminance caused by the degradation of the organic light emitting diode. Further, it is possible to compensate for the threshold voltage of the first driving transistor using the compensation unit, thereby display an image with uniform luminance.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A pixel comprising:

an organic light emitting diode;

a first driving transistor to supply current from a first power source to the organic light emitting diode, the first driving transistor to supply the current based on a voltage applied to a first node coupled to a gate electrode of the first driving transistor;

a second driving transistor coupled between a first electrode of the first driving transistor and the organic light emitting diode, the second driving transistor being turned on or turned off corresponding to a data signal supplied from a data line;

a third transistor coupled between a gate electrode of the second driving transistor and the data line, the third transistor being turned on when a scan signal is supplied to a scan line; and a compensation circuit coupled to the first node, the compensation circuit compensating for a voltage corresponding to a threshold voltage of the first driving transistor.

2. The pixel as claimed in claim 1, further comprising:

a first capacitor coupled between the gate electrode of the second driving transistor and the first power source; and a fourth transistor coupled between a second node of the compensation circuit and a bias power source, the fourth transistor being turned on when a first control signal is supplied to a first control line.

3. The pixel as claimed in claim 2, wherein the compensation circuit includes:

a fifth transistor coupled between the first node and the second electrode of the first driving transistor, the fifth transistor being turned on when a second control signal is supplied to a second control line;

a sixth transistor coupled between the first node and an initialization power source, the sixth transistor being turned on when a third control signal is supplied to a third control line;

a seventh transistor coupled between the second node and a reference power source, the seventh transistor being turned on when the second control signal is supplied to the second control line; and a second capacitor coupled between the first and second nodes.

4. The pixel as claimed in claim 3, wherein the compensation circuit further includes a third capacitor coupled between the second node and the first power source.

5. The pixel as claimed in claim 3, wherein the reference power source is set to a voltage higher than a voltage of the bias power source.

6. The pixel as claimed in claim 3, wherein the reference power source is the first power source.

7. The pixel as claimed in claim 3, wherein the initialization power source is set to a voltage lower than a voltage of the first power source.

8. The pixel as claimed in claim 3, wherein the sixth and seventh transistors are progressively turned on during a compensation period between frames, and wherein the fourth transistor is set in a turn-on state during the frame.

9. The pixel as claimed in claim 1, further comprising:

a first capacitor coupled between the gate electrode of the second driving transistor and the first power source; and a fourth transistor coupled between a second electrode of the first driving transistor and the bias power source, the fourth transistor being turned on when a first control signal is supplied to a first control line.

10. The pixel as claimed in claim 9, wherein the compensation circuit includes:

a fifth transistor coupled between the first node and the second electrode of the first driving transistor, the fifth transistor being turned on when a second control signal is supplied to a second control line;

a sixth transistor coupled between the first node and the initialization power source, the sixth transistor being turned on when a third control signal is supplied to a third control line;

a seventh transistor coupled between the first power source and the second electrode of the first driving transistor, the seventh transistor being turned off when an emission control signal is supplied to an emission control line and turned on when the emission control signal is not supplied to the emission control line; and a second capacitor coupled between the first node and the first power source.

11. The pixel as claimed in claim 10, wherein the initialization power source is set to a voltage lower than a voltage of the first power source.

12. The pixel as claimed in claim 10, wherein the sixth and fifth transistors are progressively turned on during a compensation period between frames, and the fourth transistor is set to a turn-on state during the compensation period.

13. The pixel as claimed in claim 12, wherein the seventh transistor is set in a turn-off state during the compensation period and is set in a turn-on state during the frame after the compensation period.

14. An organic light emitting display device, comprising:

pixels positioned in an area defined by scan lines and data lines;

a bias power supply to supply a bias power source to the pixels; and a control driver to supply first, second, and third control signals respectively to first, second, and third control lines, wherein each pixel includes:

an organic light emitting diode;

a first driving transistor to supply current from a first power source to the organic light emitting diode, the first driving transistor to supply the current corresponding to a voltage applied to a first node coupled to a gate electrode of the first driving transistor;

a second driving transistor coupled between a second electrode of the first driving transistor and the organic light emitting diode, the second driving transistor being turned on or turned off corresponding to a data signal supplied from a data line;

a third transistor coupled between a gate electrode of the second driving transistor and the data line, the third transistor being turned on when a scan signal is supplied to a scan line; and a compensation circuit coupled to the first node, the compensation circuit compensating for a voltage corresponding to a threshold voltage of the first driving transistor.

15. The organic light emitting display device as claimed in claim 14, wherein the bias power supply supplies different bias power voltages to red, green, and blue pixels that generate red light, green light and blue light, respectively.

16. The organic light emitting display as claimed in claim 14, further comprising:

a scan driver to supply a scan signal to the scan lines; and a data driver to supply a data signal to the data lines.

17. The organic light emitting display device as claimed in claim 16, wherein one frame is divided into a plurality of subfields, and wherein the scan driver supplies the scan signal to the scan lines every scan period of the plurality of subfields.

18. The organic light emitting display device as claimed in claim 16, wherein the data driver supplies a first data signal to cause the pixel to emit light or a second data signal to cause the pixel not to emit light, one of the first data signal or the second data signal supplied to each data line in synchronization with the scan signal.

19. The organic light emitting display device as claimed in claim 14, wherein each pixel further includes:

a first capacitor coupled to the gate electrode of the second driving transistor and the first power source; and a fourth transistor coupled between a second node of the compensation circuit and the bias power source, the fourth transistor being turned on when the first control signal is supplied to the first control line.

20. The organic light emitting display device as claimed in claim 19, wherein the compensation circuit includes:

a fifth transistor coupled between the first node and the second electrode of the first driving transistor, the fifth transistor being turned on when a second control signal is supplied to a second control line;

a sixth transistor coupled between the first node and an initialization power source, the sixth transistor being turned on when a third control signal is supplied to a third control line;

a seventh transistor coupled between the second node and a reference power source, the seventh transistor being turned on when the second control signal is supplied to the second control line; and a second capacitor coupled between the first and second nodes.

21. The organic light emitting display device as claimed in claim 20, wherein the compensation circuit further includes a third capacitor coupled between the second node and the first power source.

22. The organic light emitting display device as claimed in claim 20, wherein the reference power source is set to a voltage higher than a voltage of the bias power source.

23. The organic light emitting display device as claimed in claim 20, wherein the reference power source is the first power source.

24. The organic light emitting display device as claimed in claim 20, wherein the initialization power source is set a voltage lower than a voltage of the first power source.

25. The organic light emitting display device as claimed in claim 20, wherein the control driver progressively supplies the second and third control signals during a compensation period between frames, and supplies the first control signal during the frame.

26. The organic light emitting display device as claimed in claim 14, wherein each pixel further includes:

a first capacitor coupled between the gate electrode of the second driving transistor and the first power source; and a fourth transistor coupled between a second electrode of the first driving transistor and the bias power source, the fourth transistor being turned on when a first control signal is supplied to a first control line.

27. The organic light emitting display device as claimed in claim 26, wherein the compensation circuit includes:

a fifth transistor coupled between the first node and the second electrode of the first driving transistor, the fifth transistor being turned on when a second control signal is supplied to a second control line;

a sixth transistor coupled between the first node and an initialization power source, the sixth transistor being turned on when a third control signal is supplied to a third control line;

a seventh transistor coupled between the first power source and the second electrode of the first driving transistor, the seventh transistor being turned off when an emission control signal is supplied to an emission control line and turned on when the emission control signal is not supplied to the emission control line; and a second capacitor coupled between the first node and the first power source.

28. The organic light emitting display device as claimed in claim 27, wherein the initialization power source is set to a voltage lower than a voltage of the first power source.

29. The organic light emitting display device as claimed in claim 27, wherein the control driver progressively supplies the second and third control signals during a compensation period between frames, and supplies the first control signal to overlap with the second and third control signals during the compensation period, and wherein the control driver supplies the emission control signal during the compensation period and does not supply the emission control signal during the frame after the compensation period.

30. The organic light emitting display device as claimed in claim 14, further comprising a fourth transistor coupled between the bias power source and a plurality of compensation circuits included in each pixel, the fourth transistor being turned on when a first control signal is supplied to a first control line.

31. The organic light emitting display device as claimed in claim 14, further comprising another transistor coupled between the reference power source and a plurality of compensation circuits included in each pixel, the other transistor being turned on when a control signal is supplied to a control line.

32. The pixel as claimed in claim 1, wherein:

the first driving transistor is to be driven in a saturation region, and the current to be supplied by the first driving transistor to the organic light emitting diode is at a substantially constant level while the first driving transistor is driven in the saturation region.

33. The pixel as claimed in claim 32, wherein the current is supplied at a substantially constant level based on a voltage of a bias power source.

34. The pixel as claimed in claim 33, wherein the voltage of the bias power source is set so that the current supplied by the first driving transistor corresponds to a predetermined gray scale value.

35. The pixel as claimed in claim 34, wherein the predetermined grayscale value is a maximum gray scale value.

* * * * *